US012789963B2

(12) United States Patent
Tagata et al.

(10) Patent No.: US 12,789,963 B2
(45) Date of Patent: Nov. 10, 2026

(54) WATERCRAFT PROPULSION SYSTEM, AND WATERCRAFT INCLUDING THE WATERCRAFT PROPULSION SYSTEM

(71) Applicant: YAMAHA HATSUDOKI KABUSHIKI KAISHA, Iwata (JP)

(72) Inventors: Akihiro Tagata, Shizuoka (JP); Katsutoshi Naito, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 496 days.

(21) Appl. No.: 18/503,448

(22) Filed: Nov. 7, 2023

(65) Prior Publication Data

US 2024/0150000 A1 May 9, 2024

(30) Foreign Application Priority Data

Nov. 8, 2022 (JP) ..... 2022-178984

(51) Int. Cl.
*B63H 20/12* (2006.01)
*B63H 5/14* (2006.01)
(Continued)

(52) U.S. Cl.
CPC ..... *B63H 20/12* (2013.01); *B63H 5/14* (2013.01); *B63H 5/16* (2013.01); *B63H 25/42* (2013.01);
(Continued)

(58) Field of Classification Search
CPC ..... B63H 5/08; B63H 5/16; B63H 2020/003; B63H 20/12; B63H 2025/026;
(Continued)

(56) References Cited

U.S. PATENT DOCUMENTS 8,190,316 B2 * 5/2012 Kaji ..... B63H 21/213 318/588
11,117,643 B2 * 9/2021 Sakashita ..... B63H 5/08
(Continued)

FOREIGN PATENT DOCUMENTS

JP 2008110749 A 5/2008
JP 2022-085659 A 6/2022
WO 2020069750 A1 4/2020

OTHER PUBLICATIONS

Official Communication issued in corresponding European Patent Application No. 23208425.1, mailed on May 6, 2024, 8 pages.

*Primary Examiner* — Ajay Vasudeva
(74) *Attorney, Agent, or Firm* — Keating & Bennett, LLP

(57) ABSTRACT

A watercraft propulsion system includes a bow thruster, at least two propulsion devices, a translation operator to command a hull translation movement, and a controller configured or programmed to, in a translation watercraft maneuvering mode, control the propulsion devices so that propulsive force action lines thereof cross each other in the hull, and to drive one of the propulsion devices forward and drive another of the propulsion device in reverse. In a standby state, the controller is configured or programmed to prevent the bow thruster and the propulsion devices from generating propulsive forces, and set the steering angles of the propulsion devices to translation standby steering angles. In response to the operation of the translation operator, the controller is configured or programmed to cause the bow thruster and the propulsion devices to start generating the propulsive forces, and change the steering angles of the propulsion devices to translation steering angles.

11 Claims, 9 Drawing Sheets

(51) Int. Cl.

| | |
|---|---|
| ***B63H 5/16*** | (2006.01) |
| ***B63H 20/00*** | (2006.01) |
| ***B63H 25/02*** | (2006.01) |
| ***B63H 25/42*** | (2006.01) |
| ***B63H 25/46*** | (2006.01) |

(52) U.S. Cl.
CPC ..... *B63H 25/46* (2013.01); *B63H 2020/003* (2013.01); *B63H 2025/026* (2013.01)

(58) Field of Classification Search
CPC .. B63H 25/04; B63H 2025/045; B63H 25/42; B63H 25/46
See application file for complete search history.

(56) References Cited

U.S. PATENT DOCUMENTS

| | | | |
|---|---|---|---|
| 2014/0046515 | A1 | 2/2014 | Mizutani |
| 2020/0331578 | A1 | 10/2020 | Sakashita et al. |
| 2022/0169352 | A1 | 6/2022 | Ikegaya |

* cited by examiner

WATERCRAFT PROPULSION SYSTEM, AND WATERCRAFT INCLUDING THE WATERCRAFT PROPULSION SYSTEM

CROSS REFERENCE TO RELATED APPLICATIONS

This application claims the benefit of priority to Japanese Patent Application No. 2022-178984 filed on Nov. 8, 2022. The entire contents of this application are hereby incorporated herein by reference.

BACKGROUND OF THE INVENTION

1. Field of the Invention

The present invention relates to a watercraft propulsion system, and a watercraft including the watercraft propulsion system.

2. Description of the Related Art

US 2020/0331578 A1 discloses a watercraft propulsion system including a bow thruster provided at the bow of a hull, and two outboard motors provided on the stern of the hull. When the hull is translated according to the operation of a joystick, the steering angles of the two outboard motors are controlled so that the propulsive force action lines of the two outboard motors cross each other on the rear side of the turning center of the hull. Then, the shift position of one of the outboard motors is controlled to a forward shift position, and the shift position of the other outboard motor is controlled to a reverse shift position. Thus, the resultant propulsive force (the resultant force of the propulsive forces) of the two outboard motors acts on the hull. On the other hand, the bow thruster is driven such that the propulsive force of the bow thruster acts on the hull. The propulsive forces of the two outboard motors and the propulsive force of the bow thruster are controlled so that a moment generated by the propulsive forces of the two outboard motors is balanced with a moment generated by the propulsive force of the bow thruster such that the hull can be translated without the bow of the hull turning.

SUMMARY OF THE INVENTION

The inventors of preferred embodiments of the present invention described and claimed in the present application conducted an extensive study and research regarding a watercraft propulsion system, such as the one described above, and in doing so, discovered and first recognized new unique challenges and previously unrecognized possibilities for improvements as described in greater detail below.

In an equilibrium state after the propulsive forces of the two outboard motors and the propulsive force of the bow thruster respectively reach their target values, the hull can be translated in a direction according to the operation of the joystick. In a period of time until the propulsive forces of the two outboard motors and the propulsive force of the bow thruster respectively reach their target values, on the other hand, the propulsive forces are not necessarily properly balanced as in the equilibrium state. Therefore, a hull behavior to be observed immediately after the start of the operation of the joystick still has room for improvement.

In view of the foregoing, preferred embodiments of the present invention provide watercraft propulsion systems and watercraft that provide excellent hull behavior when the operation of a translation operator is started to command a hull translation movement.

In order to overcome the previously unrecognized and unsolved challenges described above, a preferred embodiment of the present invention provides a watercraft propulsion system including a bow thruster at a bow of a hull to generate a lateral propulsive force, at least two propulsion devices on a stern of the hull each having a variable steering angle, a translation operator to be operated by a user (an operator) to command a hull translation movement, and a controller configured or programmed to control the bow thruster and the at least two propulsion devices. The controller is configured or programmed to control, in a translation watercraft maneuvering mode, steering angles of the at least two propulsion devices so that propulsive force action lines of the at least two propulsion devices cross each other in the hull, and drive one of the at least two propulsion devices forward and drive another propulsion device in reverse in response to the operation of the translation operator. The controller is configured or programmed to, in a standby state, prevent the bow thruster and the at least two propulsion devices from generating propulsive forces, and set the steering angles of the at least two propulsion devices to translation standby steering angles without the operation of the translation operator in the translation watercraft maneuvering mode. The controller is configured or programmed to cause the bow thruster and the at least two propulsion devices to start generating the propulsive forces in response to the operation of the translation operator, and change (preferably, gradually change) the steering angles of the at least two propulsion devices from the translation standby steering angles to translation steering angles.

With this arrangement, in the translation watercraft maneuvering mode, the bow thruster and the at least two stern propulsion devices are controlled in response to the operation of the translation operator such that the hull is translated by the propulsive forces generated by the bow thruster and the at least two stern propulsion devices. The steering angles of the at least two propulsion devices are controlled so that the propulsive force action lines of the at least two propulsion devices cross each other in the hull. One of the at least two propulsion devices is driven forward, and another of the at least two propulsion devices is driven in reverse. Thus, the resultant propulsive force (the resultant force of the propulsive forces) of the at least two propulsion devices can have a greater lateral component with respect to the lateral direction of the hull. The resultant propulsive force and the propulsive force of the bow thruster can apply a greater propulsive force to the hull for the translation of the hull.

In the standby state without the operation of the translation operator, none of the bow thruster and the at least two propulsion devices generate the propulsive forces. At this time, the steering angles of the at least two propulsion devices are controlled to the translation standby steering angles. When the translation operator is operated, the bow thruster and the at least two propulsion devices start generating the propulsive forces in response to the operation of the translation operator. At the same time, the steering angles of the at least two propulsion devices are changed (preferably, gradually changed) from the translation standby steering angles to the translation steering angles. Thus, the steering angles of the at least two propulsion devices are changed according to the increase in the propulsive forces of the bow thruster and the at least two propulsion devices. Therefore, a hull behavior observed at this time is different from that observed when the steering angles of the at least two propulsion devices are set to the translation steering angles at the beginning of the generation of the propulsive forces. Thus, an excellent hull behavior can be achieved even immediately after the operation of the translation operator.

In a preferred embodiment of the present invention, steering speeds at which the steering angles of the at least two propulsion devices are respectively changed from the translation standby steering angles to the translation steering angles (the change rates of the steering angles) are set in accordance with a propulsive force increasing characteristic of the bow thruster.

With this arrangement, the steering speeds at which the steering angles are respectively changed from the translation standby steering angles to the translation steering angles conform to the propulsive force increasing characteristic of the bow thruster and, therefore, an excellent hull behavior can be achieved even immediately after the operation of the translation operator.

Examples of the propulsive force increasing characteristic of the bow thruster include the increasing characteristic of a drive source (typically, an electric motor) of the bow thruster, and a delay in the application of the propulsive force of the bow thruster to the hull due to a water jet generated by the bow thruster.

In a preferred embodiment of the present invention, the translation standby steering angles are smaller in absolute value than the translation steering angles when the hull is translated without the bow of the hull turning.

As the absolute values of the steering angles increase, the lateral component of the resultant propulsive force of the at least two propulsion devices is increased. Therefore, where the translation standby steering angles are set smaller in absolute value than the translation steering angles, the lateral component of the resultant propulsive force of the at least two propulsion devices can be relatively reduced immediately after the operation of the translation operator. Thereafter, the steering angles of the at least two propulsion devices are changed (increased in absolute value) to the translation steering angles such that the lateral component of the resultant propulsive force of the at least two propulsion devices is increased. Thus, the propulsive force of the bow thruster and the resultant propulsive force of the at least two propulsion devices can be properly balanced in a period of time immediately after the operation of the translation operator. Thus, an excellent hull behavior can be achieved.

In a preferred embodiment of the present invention, the controller includes a cooperative mode in which the bow thruster and the at least two propulsion devices are cooperatively driven and a non-cooperative mode in which the bow thruster is stopped. The controller is configured or programmed to cause the at least two propulsion devices to generate the propulsive forces, and control the steering angles of the at least two propulsion devices to non-cooperative translation steering angles different from the translation steering angles in response to the operation of the translation operator when the translation watercraft maneuvering mode is effected in the non-cooperative mode (with the bow thruster stopped).

With this arrangement, in the non-cooperative mode in which the propulsive force of the bow thruster is not utilized, the hull can be translated by setting the steering angles of the at least two propulsion devices to the non-cooperative translation steering angles that are different from the translation steering angles used in the cooperative mode.

In a preferred embodiment of the present invention, the controller is configured or programmed to, in the standby state, prevent the at least two propulsion devices from generating the propulsive forces, and control the steering angles of the at least two propulsion devices to non-cooperative translation standby steering angles smaller in absolute value than the translation standby steering angles without the operation of the translation operator when the translation watercraft maneuvering mode is effected in the non-cooperative mode (with the bow thruster stopped).

With this arrangement, neither of the at least two propulsion devices generates the propulsive force in the standby state without the operation of the translation operator in the non-cooperative mode in which the propulsive force of the bow thruster is not utilized. At this time, the steering angles of the at least two propulsion devices are controlled to the non-cooperative translation standby steering angles. When the translation operator is operated, the at least two propulsion devices start generating the propulsive forces in response to the operation of the translation operator. At the same time, the steering angles of the at least two propulsion devices are changed (preferably, gradually changed) from the non-cooperative translation standby steering angles to the non-cooperative translation steering angles. The steering angles of the at least two propulsion devices are thus changed according to the increase in the propulsive forces of the at least two propulsion devices. Therefore, a hull behavior observed at this time is different from that observed when the steering angles of the at least two propulsion devices are set to the non-cooperative translation steering angles at the beginning of the generation of the propulsive forces. Thus, an excellent hull behavior can be achieved even immediately after the operation of the translation operator.

In the cooperative mode, the propulsive force of the bow thruster is utilized so that the propulsive force action lines of the at least two propulsion devices can cross each other on the rear side of the turning center of the hull in the translation watercraft maneuvering mode. This is because the intersection of the propulsive force action lines of the at least two propulsion devices defines the action point of the resultant propulsive force, and a moment applied to the hull by the resultant propulsive force is cancelled (at least partially cancelled) by a moment applied to the hull by the bow thruster such that the bow turning of the hull can be controlled. In the non-cooperative mode, in contrast, the propulsive force of the bow thruster is not utilized, so that a reference position for the intersection of the propulsive force action lines of the at least two propulsion devices is located at the turning center of the hull. In the cooperative mode, therefore, the translation steering angles are defined with respect to a position rearward of the turning center of the hull. In the non-cooperative mode, the non-cooperative translation steering angles are defined with respect to the turning center of the hull. Therefore, the translation standby steering angles in the cooperative mode are set greater in absolute value than the non-cooperative translation standby steering angles such that a change amount from the translation standby steering angles to the translation steering angles can be reduced in the cooperative mode. Thus, an excellent hull behavior can be achieved in the period of time immediately after the operation of the translation operator.

In a preferred embodiment of the present invention, when the hull is translated without the bow turning of the hull in the non-cooperative mode, the non-cooperative translation steering angles are such that the propulsive force action lines of the at least two propulsion devices cross each other at the turning center of the hull.

With this arrangement, the steering angles of the at least two propulsion devices are controlled so that the propulsive force action lines of the at least two propulsion devices cross each other at the turning center of the hull such that the translation movement can be achieved without the bow of the hull turning.

The translation movement with the bow turning of the hull can be achieved by controlling the steering angles of the at least two propulsion devices so that the propulsive force action lines of the at least two propulsion devices cross each other on the front side or on the rear side of the turning center of the hull, and applying a necessary moment to the hull about the turning center of the hull.

In a preferred embodiment of the present invention, the translation standby steering angles are such that the propulsive force action lines of the at least two propulsion devices cross each other at the turning center of the hull or on the rear side of the turning center of the hull.

In the cooperative mode, the translation steering angles are such that the propulsive force action line of the at least two propulsion devices cross each other on the rear side of the turning center such that a moment applied to the hull by the resultant propulsive force of the at least two propulsion devices can be cancelled (at least partially cancelled) by a moment applied to the hull by the propulsive force of the bow thruster. By thus controlling the bow turning of the hull, the hull can be translated. Where the translation movement accompanies the bow turning or a great external disturbance is present, the translation steering angles may be set so as to allow the propulsive force action lines of the at least two propulsion devices to cross each other at the turning center or on the front side of the turning center in order to maximally utilize the bow turning moment applied by the propulsive force of the bow thruster.

Immediately after the operation of the translation operator, the translation steering angles are considered to be set, in most cases, so as to allow the propulsive force action lines of the at least two propulsion devices to cross each other on the rear side of the turning center. Therefore, the translation standby steering angles for the cooperative mode are set so that the propulsive force action lines of the at least two propulsion devices cross each other at the turning center or on the rear side of the turning center. In most cases, therefore, the direction of the moment applied to the hull by the resultant propulsive force is less likely to be changed during a period of time in which the steering angles of the at least two propulsion devices are changed from the translation standby steering angles to the translation steering angles. Thus, an excellent hull behavior can be achieved.

In a preferred embodiment of the present invention, the propulsion devices are outboard motors.

In another preferred embodiment of the present invention, a watercraft includes a hull and a watercraft propulsion system provided on the hull and including any of the aforementioned features.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
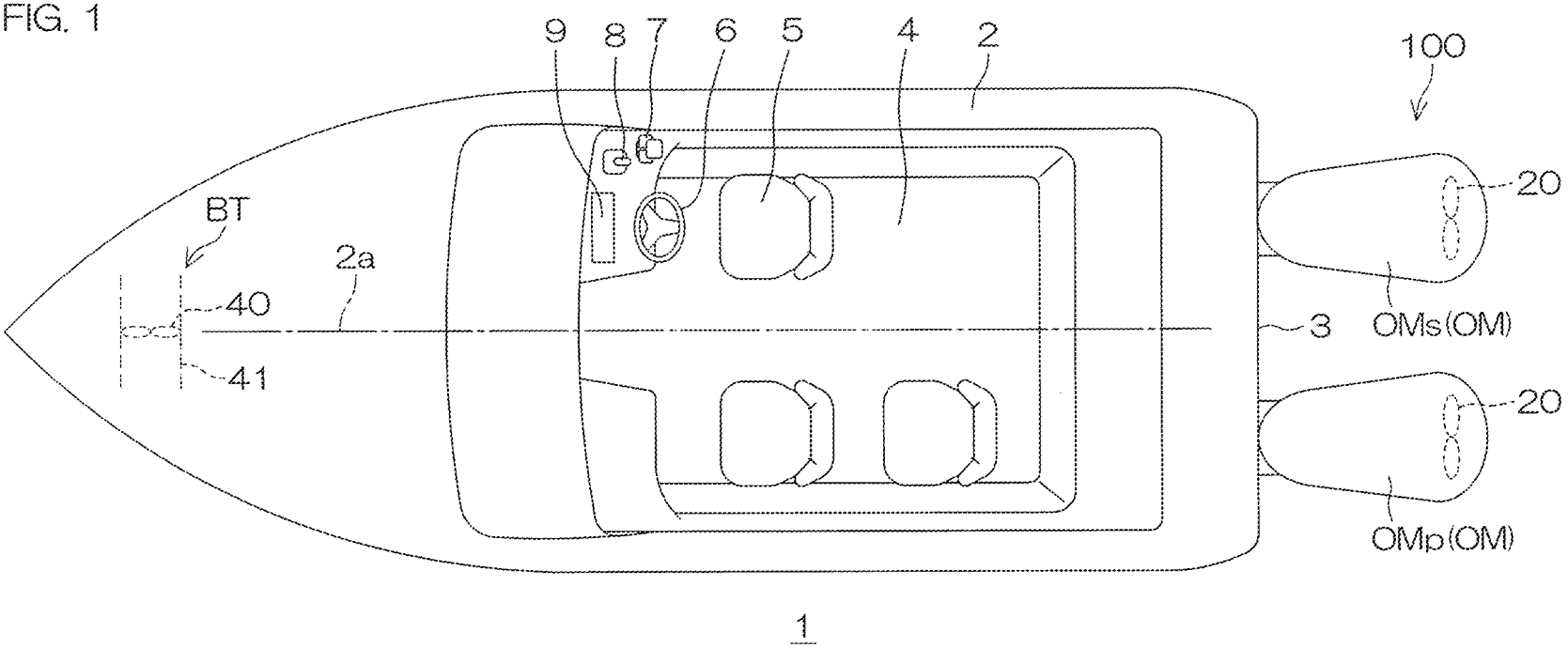
FIG. 1 is a plan view showing an exemplary construction of a watercraft mounted with a watercraft propulsion system according to a preferred embodiment of the present invention.

FIG. 1 is a plan view showing an exemplary construction of a watercraft 1 mounted with a watercraft propulsion system 100 according to a preferred embodiment of the present invention. The watercraft 1 includes a hull 2, a bow thruster BT provided at the bow of the hull 2 to generate a lateral propulsive force, and outboard motors OM (examples of the propulsion device) provided on the stern 3 of the hull 2 and each having a variable steering angle. In this preferred embodiment, a plurality of outboard motors OM, more specifically, two outboard motors OM are provided on the stern 3.

The two outboard motors OM are disposed side by side transversely of the hull 2 on the stern 3. For discrimination between the two outboard motors OM, one of the outboard motors OM disposed rightward relative to the other outboard motor OM is referred to as "starboard-side outboard motor OMs" and the other outboard motor OM disposed leftward relative to the one outboard motor OM is referred to as "port-side outboard motor OMp." In this example, the starboard-side outboard motor OMs is disposed on the right side of a center line 2*a* extending anteroposteriorly of the hull 2, and the port-side outboard motor OMp is disposed on the left side of the center line 2*a*. More specifically, the starboard-side outboard motor OMs and the port-side outboard motor OMp are disposed symmetrically with respect to the center line 2*a*.

The outboard motors OM each include a propeller 20 located underwater, and are each configured to generate a propulsive force by the rotation of the propeller 20 and apply the propulsive force to the hull 2. The outboard motors OM are each attached to the stern 3 pivotably leftward and rightward such that the direction of the propulsive force generated by the propeller 20 is changed leftward and rightward. The steering angle is defined, for example, as an angle between the direction of the propulsive force generated by the propeller 20 and an anteroposterior reference direction parallel to the center line 2*a*. The outboard motors OM are each configured to be pivoted leftward and rightward by a steering mechanism 26 thereof (see FIG. 2) to change the steering angle. When the propulsive force direction is parallel to the anteroposterior direction, the steering angle is zero. When the rear end of the outboard motor OM is directed rightward, the steering angle may be expressed with a positive sign. When the rear end of the outboard motor OM is directed leftward, the steering angle may be expressed with a negative sign.

The bow thruster BT includes a propeller 40 disposed in a tubular tunnel 41 extending through the bow portion of the hull 2 transversely of the hull 2. The propeller 40 is rotatable in a forward rotation direction and a reverse rotation direction, i.e., is bidirectionally rotatable such that the bow thruster BT can apply a rightward or leftward propulsive force to the hull 2. In this preferred embodiment, the direction of the propulsive force to be generated by the bow thruster BT cannot be set to a direction other than the rightward direction and the leftward direction.

A usable space 4 for passengers is provided inside the hull 2. A helm seat 5 is provided in the usable space 4. A steering wheel 6, a remote control lever 7, a joystick 8, a gauge 9 (display panel) and the like are provided in association with the helm seat 5. The steering wheel 6 is an operator to be operated by a user (an operator) to change the course of the watercraft 1. The remote control lever 7 is an operator to be operated by the user to change the magnitudes (outputs) and the directions (forward or reverse directions) of the propulsive forces of the outboard motors OM, and corresponds to an acceleration operator. The joystick 8 is an operator to be operated instead of the steering wheel 6 and the remote control lever 7 by the user during a watercraft maneuvering operation. An operator 45 (see FIG. 2) dedicated for the operation of the bow thruster BT may be provided in addition to the aforementioned operators.

Figure 2:
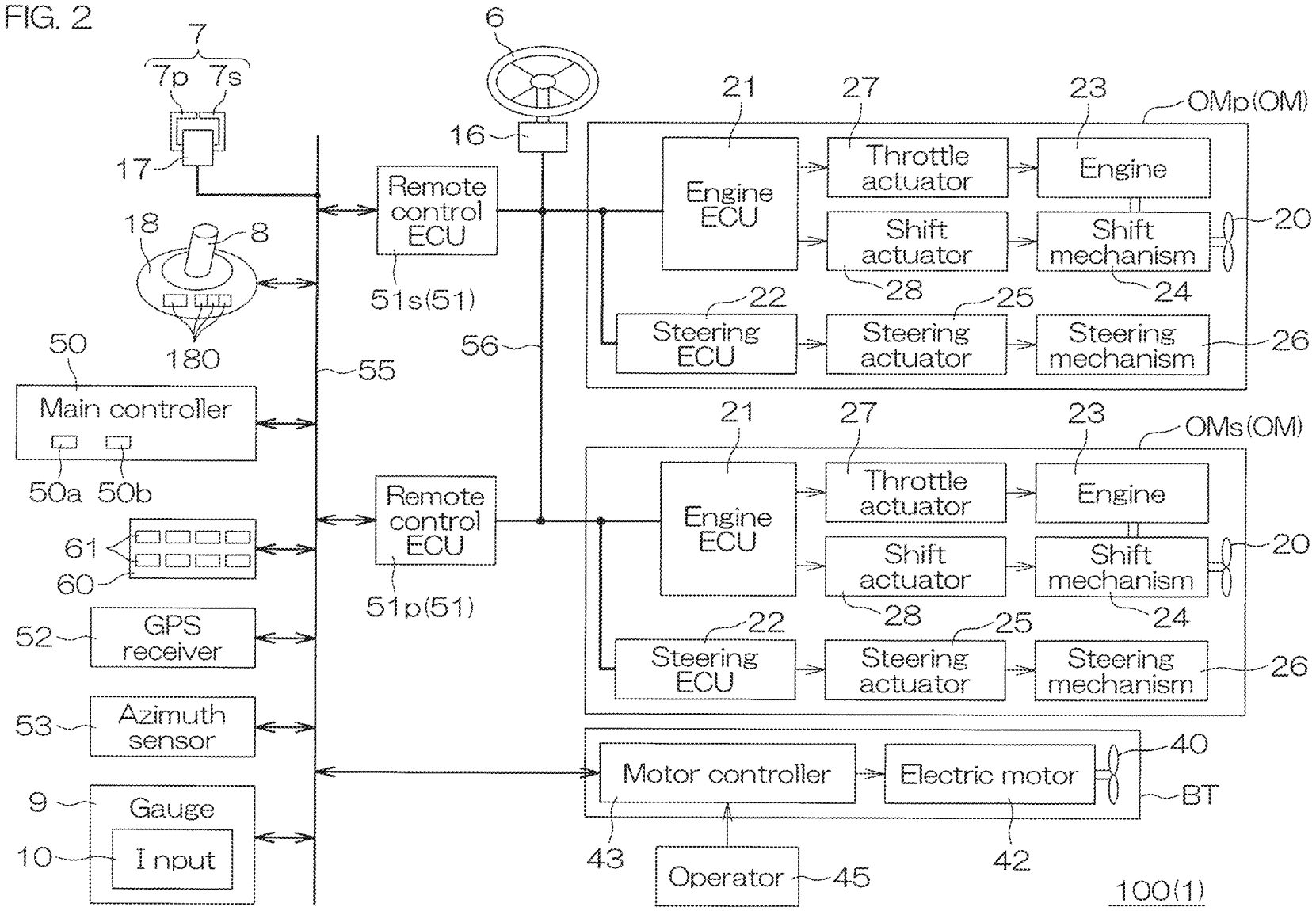
FIG. 2 is a block diagram showing a configuration of the watercraft propulsion system by way of example.

FIG. 2 is a block diagram showing the configuration of the watercraft propulsion system 100 provided in the watercraft 1 by way of example. The watercraft propulsion system 100 includes the two outboard motors OM and the bow thruster BT. The outboard motors OM may each be an engine outboard motor or an electric outboard motor. In FIG. 2, the outboard motors OM are engine outboard motors by way of example.

The outboard motors OM each include an engine ECU (Electronic Control Unit) 21, a steering ECU 22, an engine 23, a shift mechanism 24, a propeller 20, the steering mechanism 26 and the like. Power generated by the engine 23 is transmitted to the propeller 20 via the shift mechanism 24. The steering mechanism 26 is configured to pivot the body of the outboard motor OM leftward and rightward with respect to the hull 2 (see FIG. 1) to change the direction of the propulsive force generated by the outboard motor OM leftward and rightward. The shift mechanism 24 is configured to select a shift position from a forward shift position, a reverse shift position, and a neutral shift position. With the shift position set to the forward shift position, the propeller 20 is rotated in a forward rotation direction by the transmission of the rotation of the engine 23 such that the outboard motor OM is brought into a forward drive state to generate a forward propulsive force. With the shift position set to the reverse shift position, the propeller 20 is rotated in a reverse rotation direction by the transmission of the rotation of the engine 23 such that the outboard motor OM is brought into a reverse drive state to generate a reverse propulsive force. With the shift position set to the neutral shift position, the power transmission between the engine 23 and the propeller 20 is interrupted such that the outboard motor OM is brought into an idling state.

The outboard motors OM each further include a throttle actuator 27 and a shift actuator 28, which are controlled by the engine ECU 21. The throttle actuator 27 is an electric actuator (typically including an electric motor) that actuates the throttle valve (not shown) of the engine 23. The shift actuator 28 actuates the shift mechanism 24. The outboard motors OM each further include a steering actuator 25 to be controlled by the steering ECU 22. The steering actuator 25 is the drive source of the steering mechanism 26, and typically includes an electric motor. The steering actuator 25 may include a hydraulic device of electric pump type.

The bow thruster BT includes the propeller 40, an electric motor 42 that drives the propeller 40, and a motor controller 43 that controls the electric motor 42.

The watercraft propulsion system 100 further includes a main controller 50. The main controller 50 includes a processor 50*a* and a memory 50*b*, and is configured so that the processor 50*a* executes a program stored in the memory 50*b* to perform a plurality of functions. The main controller 50 is connected to an onboard network 55 (CAN: Control Area Network) provided in the hull 2. A remote control unit 17, two remote control ECUs 51, a joystick unit 18, a GPS (Global Positioning System) receiver 52, an azimuth sensor 53 and the like are connected to the onboard network 55.

The two remote control ECUs 51 (51*s*, 51*p*) are provided in association with the two outboard motors OM (OMs, OMp), respectively, and are connected to the onboard network 55. The engine ECU 21 and the steering ECU 22 of the starboard-side outboard motor OMs, and the engine ECU 21 and the steering ECU 22 of the port-side outboard motor OMp are connected to the corresponding remote control ECUs 51*s*, 51*p* via an outboard motor control network 56. The main controller 50 transmits and receives signals to/from various units connected to the onboard network 55 to control the outboard motors OM and the bow thruster BT, and further controls other units. The main controller 50 includes a plurality of control modes, and controls the units in predetermined manners according to the respective control modes.

A steering wheel unit 16 is connected to the outboard motor control network 56. The steering wheel unit 16 outputs an operation angle signal indicating the operation angle of the steering wheel 6 to the outboard motor control network 56. The operation angle signal is received by the remote control ECUs 51 and the steering ECUs 22. In response to the operation angle signal generated by the steering wheel unit 16 or steering angle commands respectively generated by the remote control ECUs 51, the steering ECUs 22 of the outboard motors OM respectively control the steering actuators 25 to control the steering angles of the outboard motors OM.

The remote control unit 17 generates an operation position signal indicating the operation position of the remote control lever 7. The remote control unit 17 includes a starboard-side remote control lever 7*s* and a port-side remote control lever 7*p* respectively provided in association with the starboard-side outboard motor OMs and the port-side outboard motor OMp.

The joystick unit 18 generates an operation position signal indicating the operation position of the joystick 8, and generates an operation signal indicating the operation of any of operation buttons 180 provided in the joystick unit 18.

The remote control ECUs 51 each output a propulsive force command to the corresponding engine ECU 21 via the outboard motor control network 56. The propulsive force command includes a shift command indicating the shift position, and an output command indicating an engine output (specifically, an engine rotation speed). Further, the remote control ECUs 51 each output the steering angle command to the corresponding steering ECU 22 via the outboard motor control network 56.

The remote control ECUs 51 each perform different control operations according to different control modes of the main controller 50. In a control mode for watercraft maneuvering with the use of the steering wheel 6 and the remote control lever 7, for example, the remote control ECUs 51 each generate the propulsive force command (the shift command and the output command) according to the operation position signal generated by the remote control unit 17, and each apply the propulsive force command (the shift command and the output command) to the corresponding engine ECU 21. Further, the remote control ECUs 51 each command the corresponding steering ECU 22 to conform to the operation angle signal generated by the steering wheel unit 16. In a control mode for watercraft maneuvering without the use of the steering wheel 6 and the remote control lever 7, on the other hand, the remote control ECUs 51 each conform to commands applied by the main controller 50. That is, the main controller 50 generates the propulsive force command (the shift command and the output command) and the steering angle command, and the remote control ECUs 51 each output the propulsive force command (the shift command and the output command) and the steering angle command to the engine ECU 21 and the steering ECU 22, respectively. In a control mode for watercraft maneuvering with the use of the joystick 8 (joystick mode), for example, the main controller 50 generates the propulsive force command (the shift command and the output command) and the steering angle command according to the signals generated by the joystick unit 18. The magnitude and the direction (the forward direction or the reverse direction) of the propulsive force and the steering angle of each of the outboard motors OM are controlled according to the propulsive force command (the shift command and the output command) and the steering angle command thus generated.

The engine ECU 21 of each of the outboard motors OM drives the shift actuator 28 according to the shift command to control the shift position, and drives the throttle actuator 27 according to the output command to control the throttle opening degree of the engine 23. The steering ECU 22 of each of the outboard motors OM controls the steering actuator 25 according to the steering angle command to control the steering angle of the outboard motor OM.

The motor controller 43 of the bow thruster BT is connected to the onboard network 55, and is configured to actuate the electric motor 42 in response to a command applied from the main controller 50. The motor controller 43 may be connected to the onboard network 55 via a gateway (not shown). The main controller 50 applies a propulsive force command to the motor controller 43. The propulsive force command includes a shift command and an output command. The shift command is a rotation direction command that indicates the stop, the forward rotation or the reverse rotation of the propeller 20. The output command is a rotation speed command that indicates a propulsive force to be generated, specifically, a target rotation speed value. The motor controller 43 controls the rotation direction and the rotation speed of the electric motor 42 according to the shift command (rotation direction command) and the output command.

In this example, the operator 45 dedicated for the bow thruster BT is connected to the motor controller 43. The user can adjust the rotation direction and the rotation speed of the bow thruster BT by operating the operator 45.

The GPS receiver 52 is an exemplary position detecting device. The GPS receiver 52 detects the position of the watercraft 1 by receiving radio waves from an artificial satellite orbiting the earth, and outputs position data indicating the position of the watercraft 1 and speed data indicating the moving speed of the watercraft 1. The main controller 50 acquires the position data and the speed data, which are used to control and display the position and/or the azimuth of the watercraft 1.

The azimuth sensor 53 detects the azimuth of the watercraft 1, and generates azimuth data, which is used by the main controller 50.

The gauge 9 is also connected to the onboard network 55. The gauge 9 is a display device that displays various information for the watercraft maneuvering. The gauge 9 can communicate, for example, with the main controller 50, the remote control ECUs 51 and the motor controller 43. Thus, the gauge 9 can display information such as of the operation states of the outboard motors OM, the operation state of the bow thruster BT, and the position and/or the azimuth of the watercraft 1. The gauge 9 may include an input device 10 such as a touch panel and buttons. The input device 10 may be operated by the user to set various settings and provide various commands such that operation signals are outputted to the onboard network 55. An additional network other than the onboard network 55 may be provided to transmit display control signals related to the gauge 9.

An application switch panel 60 is connected to the onboard network 55. The application switch panel 60 includes a plurality of function switches 61 to be operated to apply predefined function commands. For example, the function switches 61 may include switches for automatic watercraft maneuvering commands. More specifically, a command for a bow holding mode (Heading Hold) in which an automatic steering operation is performed to maintain the bow azimuth during forward sailing may be assigned to one of the function switches 61, and a command for a straight sailing holding mode (Course Hold) in which an automatic steering operation is performed to maintain the bow azimuth and a straight course during forward sailing may be assigned to another of the function switches 61. Further, a command for a checkpoint following mode (Track Point™) in which an automatic steering operation is performed to follow a course (route) passing through specified checkpoints may be assigned to further another of the function switches 61, and a command for a pattern sailing mode (Pattern Steer) in which an automatic steering operation is performed to follow a predetermined sailing pattern (zig-zag pattern, spiral pattern or the like) may be assigned to still another of the function switches 61.

Figure 3:
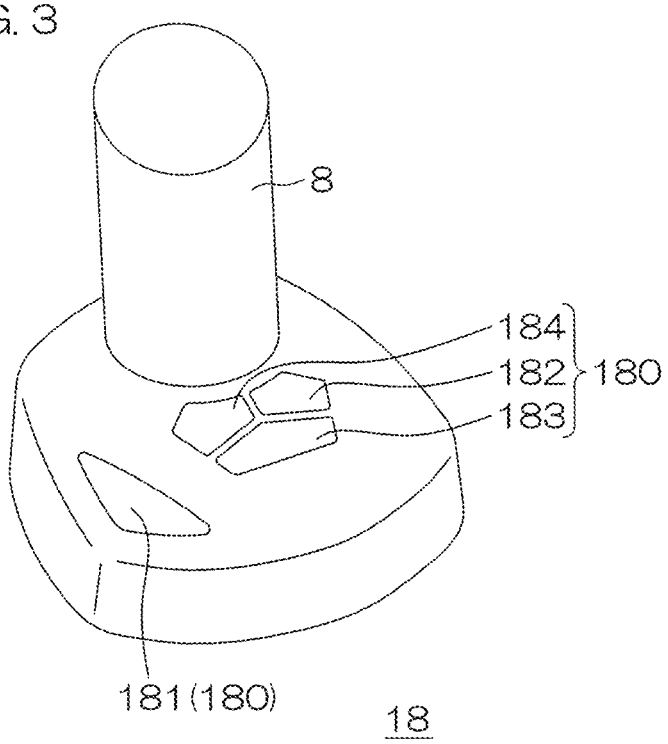
FIG. 3 is a perspective view showing the structure of a joystick unit by way of example.

FIG. 3 is a perspective view showing the structure of the joystick unit 18 by way of example. The joystick unit 18 includes the joystick 8, which can be inclined forward, backward, leftward, and rightward (i.e., in all 360-degree directions) and can be pivoted (twisted) about its axis. In this example, the joystick unit 18 further includes the operation buttons 180. The operation buttons 180 include a joystick button 181 and holding mode setting buttons 182 to 184.

The joystick button 181 is an operator to be operated by the user to select a control mode (watercraft maneuvering mode) utilizing the joystick 8, i.e., the joystick mode.

The holding mode setting buttons 182, 183, 184 are operation buttons to be operated by the user to select position/azimuth holding control modes (examples of an automatic watercraft maneuvering mode). More specifically, the holding mode setting button 182 is operated to select a fixed point holding mode (Stay Point™) in which the position and the bow azimuth (or the stern azimuth) of the watercraft 1 are maintained. The holding mode setting button 183 is operated to select a position holding mode (Fish Point™) in which the position of the watercraft 1 is maintained but the bow azimuth (or the stern azimuth) of the watercraft 1 is not maintained. The holding mode setting button 184 is operated to select an azimuth holding mode (Drift Point™) in which the bow azimuth (or the stern azimuth) of the watercraft 1 is maintained but the position of the watercraft 1 is not maintained.

The control mode of the main controller 50 can be classified into an ordinary mode, the joystick mode or the automatic watercraft maneuvering mode in terms of the operation system.

In the ordinary mode, a steering control operation is performed according to the operation angle signal generated by the steering wheel unit 16, and a propulsive force control operation is performed according to the operation signal (operation position signal) of the remote control lever 7. In this preferred embodiment, the ordinary mode is a default control mode of the main controller 50. In the steering control operation, specifically, the steering ECUs 22 of the outboard motors OM respectively drive the steering actuators 25 according to the operation angle signal generated by the steering wheel unit 16 or the steering angle commands generated by the remote control ECUs 51. Thus, the bodies of the outboard motors OM are steered leftward and rightward such that the propulsive force directions of the outboard motors OM are changed leftward and rightward with respect to the hull 2. In the propulsive force control operation, specifically, the engine ECUs 21 of the outboard motors OM drive the shift actuators 28 and the throttle actuators 27 according to the propulsive force commands (the shift commands and the output commands) applied from the remote control ECUs 51 to the engine ECUs 21. Thus, the shift positions of the outboard motors OM are each set to the forward shift position, the reverse shift position, or the neutral shift position, and the engine outputs (specifically, the engine rotation speeds) of the outboard motors OM are changed.

In the joystick mode, the steering control operation and the propulsive force control operation are performed according to the operation signal of the joystick 8 of the joystick unit 18.

In the joystick mode, the steering control operation and the propulsive force control operation are performed on the outboard motors OM. That is, the main controller 50 applies the steering angle command and the propulsive force command to the remote control ECUs 51, and the remote control ECUs 51 apply the steering angle command to the steering ECUs 22 and apply the propulsive force command to the engine ECUs 21.

In the automatic watercraft maneuvering mode, the steering control operation and/or the propulsive force control operation are automatically performed by the functions of the main controller 50 and the like without the operation of the steering wheel 6, the remote control lever 7, and the joystick 8. That is, an automatic watercraft maneuvering operation is performed. The automatic watercraft maneuvering operation includes an automatic watercraft maneuvering operation to be performed on a sailing basis during sailing, and an automatic watercraft maneuvering operation to be performed on a position/azimuth holding basis to maintain the position and/or the azimuth. Examples of the automatic watercraft maneuvering operation on the sailing basis include the automatic steering operations to be selected by operating the function switches 61. Examples of the automatic watercraft maneuvering operation on the position/azimuth holding basis include watercraft maneuvering operations to be performed in the fixed point holding mode, the position holding mode and the azimuth holding mode which are respectively selected by operating the holding mode setting buttons 182, 183, 184.

Figure 4A:
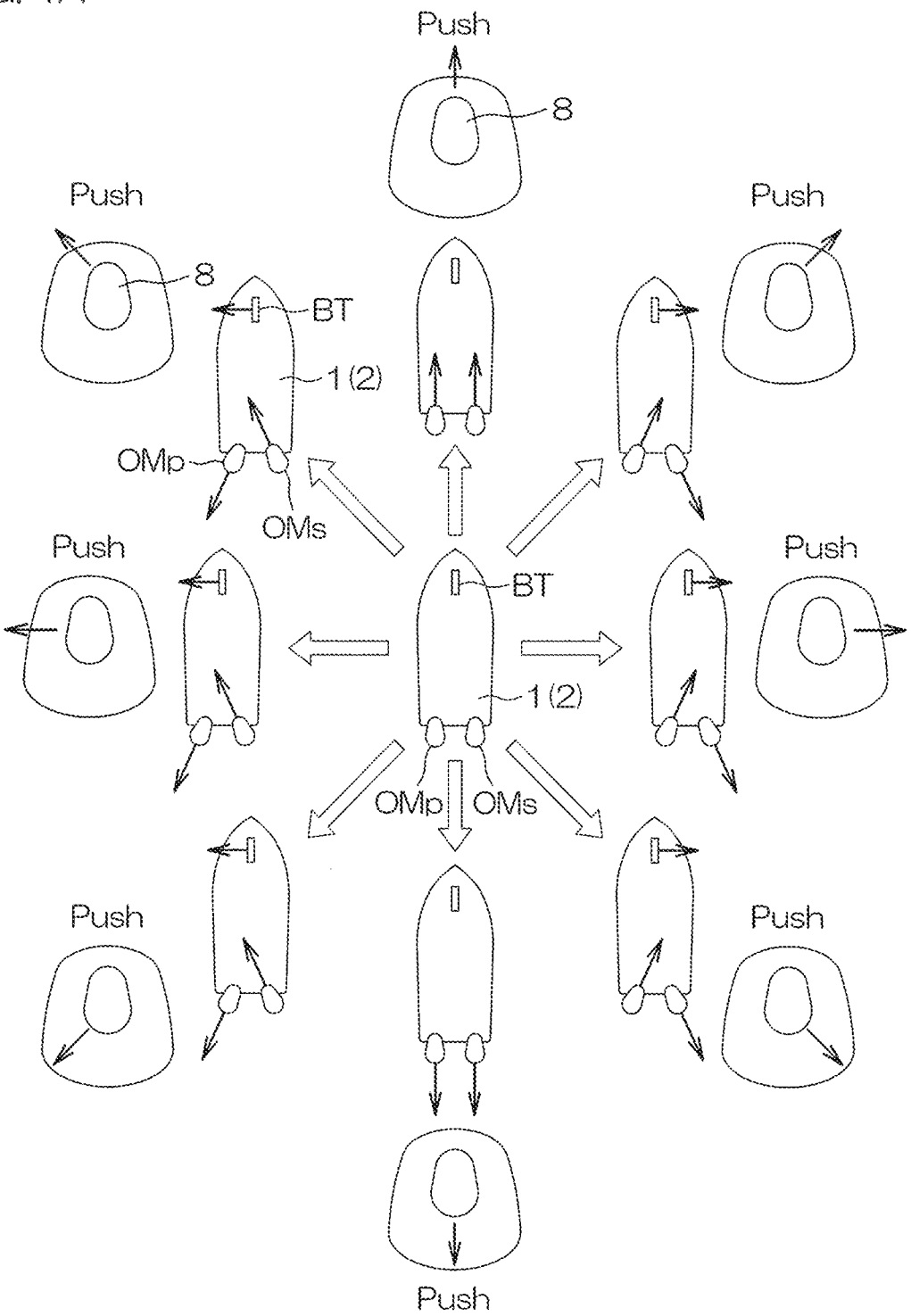
FIG. 4A is a diagram for describing a joystick mode in a cooperative mode showing operation states of a joystick and corresponding hull behaviors (translation).
Figure 4B:
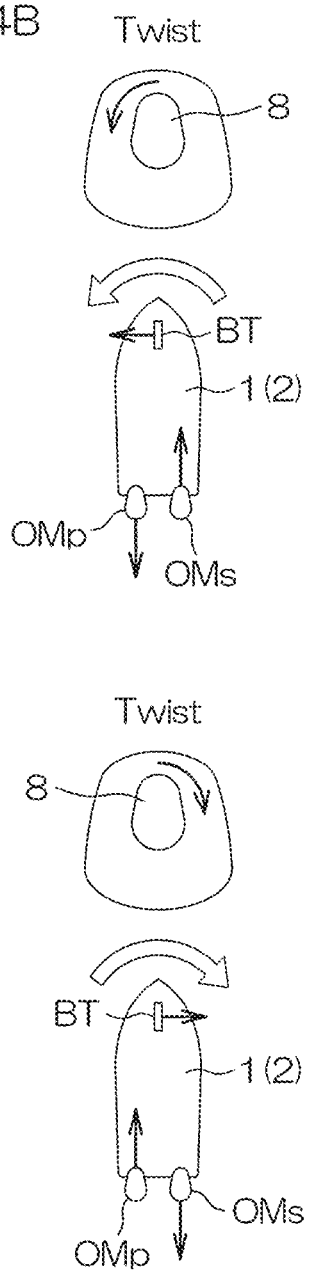
FIG. 4B is a diagram for describing the joystick mode in the cooperative mode showing operation states of the joystick and corresponding hull behaviors (fixed point bow turning).

In this preferred embodiment, a cooperative mode in which the outboard motors OM and the bow thruster BT cooperate to achieve an intended hull behavior or a non-cooperative mode in which the outboard motors OM and the bow thruster BT do not cooperate can be selected in the joystick mode and the automatic watercraft maneuvering mode. A selection operator to be operated by the user to select the cooperative mode or the non-cooperative mode, for example, may be assigned to any of the function switches 61 provided on the application switch panel 60. In the cooperative mode, the main controller 50 performs the steering control operation and the propulsive force control operation on the outboard motors OM and, in addition, performs the propulsive force control operation on the bow thruster BT. FIGS. 4A and 4B are diagrams for describing the joystick mode in the cooperative mode, showing operation states of the joystick 8 and corresponding behaviors of the hull 2. If the joystick mode is selected by operating the joystick button 181, the main controller 50 performs a joystick mode control operation. If the cooperative mode is selected before the joystick mode is selected, or if the cooperative mode is selected after the joystick mode is selected, the main controller 50 performs the joystick mode control operation according to the cooperative mode. If the cooperative mode is not selected, the main controller 50 performs the joystick mode control operation according to the non-cooperative mode.

The main controller 50 defines the inclination direction of the joystick 8 as an advancing direction command, and defines the inclination amount of the joystick 8 as a propulsive force magnitude command that indicates the magnitude of the propulsive force to be applied in the advancing direction. Further, the main controller 50 defines the pivoting direction of the joystick 8 about its axis (with respect to the neutral position of the joystick 8) as a bow turning direction command, and defines the pivoting amount of the joystick 8 (with respect to the neutral position of the joystick 8) as a bow turning speed command. For execution of these commands, the main controller 50 inputs the steering angle command and the propulsive force command to the remote control ECUs 51, and inputs the propulsive force command to the motor controller 43 of the bow thruster BT. The remote control ECUs 51 transmit the steering angle command to the steering ECUs 22 of the respective outboard motors OM, and transmit the propulsive force command to the engine ECUs 21 of the respective outboard motors OM. Thus, the outboard motors OM are respectively steered to steering angles according to the steering command, and the shift positions and the engine rotation speeds of the respective outboard motors OM are controlled to generate propulsive forces according to the propulsive force command. Further, the motor controller 43 controls the rotation direction and the rotation speed of the electric motor 42 so as to generate a propulsive force having a direction and a magnitude according to the propulsive force command.

When the joystick 8 is inclined without being pivoted in the joystick mode, the hull 2 is moved in a direction corresponding to the inclination direction of the joystick 8 without the bow turning, i.e., with its azimuth maintained. That is, the hull 2 is in a hull behavior of translation movement. Examples of the translation movement are shown in FIG. 4A. In this preferred embodiment, the joystick 8 is an example of the translation operator to be operated by the user to command the translation movement of the hull 2. A control mode of the main controller 50 in which the translation movement is achieved according to the operation (inclination operation) of the joystick 8 as shown in FIG. 4A corresponds to the translation watercraft maneuvering mode.

Figure 5A:
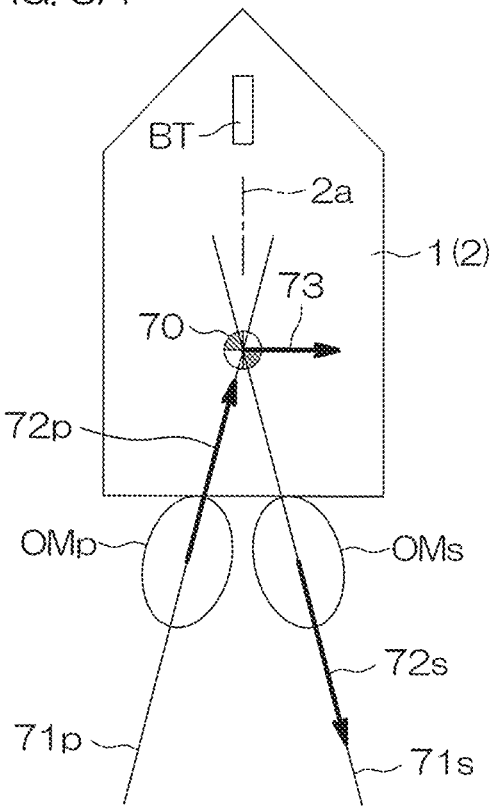
FIGS. 5A and 5B are diagrams for describing examples of the translation to be respectively observed in a non-cooperative mode and in the cooperative mode.
Figure 5B:
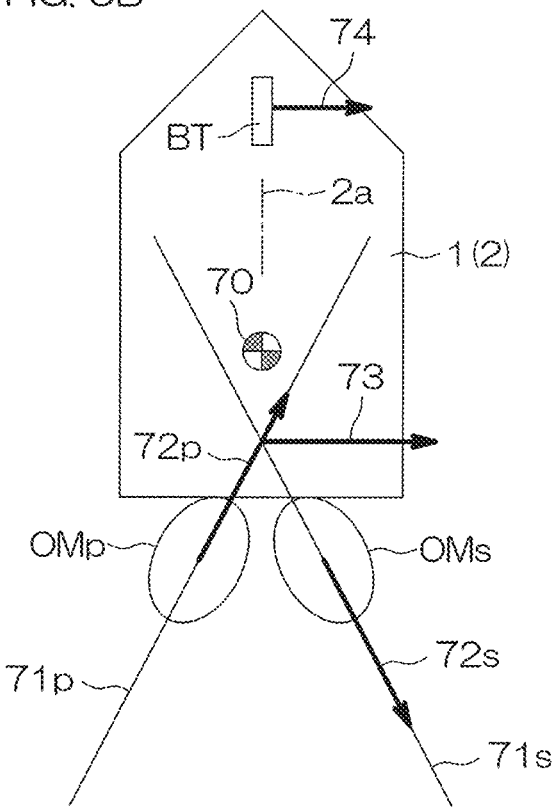

The translation movement is typically achieved by driving one of the outboard motors OM forward and driving the other outboard motor OM reverse with the propulsive force action lines 71*s*, 71*p* of the two outboard motors OMs, OMp crossing each other in the hull 2 as shown in FIGS. 5A and 5B. The propulsive force action lines 71*s*, 71*p* respectively extend through the action points of the propulsive forces 72*s*, 72*p* of the outboard motors OMs, OMp along the directions of the propulsive forces 72*s*, 72*p*. The two outboard motors OM are steered in an inverted V-shaped orientation as seen in plan (in a so-called toe-in orientation). The steering angles of the outboard motors OM observed when the two outboard motors OM are thus steered in the inverted V-shaped orientation with their propulsive force action lines 71*s*, 71*p* crossing each other in the hull 2 are hereinafter referred to as "translation mode steering angles."

In the non-cooperative mode, as shown in FIG. 5A, the bow thruster BT is in a stop state, and the steering angles of the two outboard motors OM are controlled so that the propulsive force action lines 71*s*, 71*p* of the outboard motors OM cross each other at the turning center 70 (resistance center) of the hull 2. Thus, a resultant propulsive force 73 which is the resultant force of the propulsive forces 72*s*, 72*p* generated by the two outboard motors OMs, OMp causes the hull 2 to translate (to move parallel) without applying a moment to the hull 2. With the steering angles of the two outboard motors OMs, OMp set to the translation mode steering angles, one of the two outboard motors OMs, OMp is driven forward, and the other of the two outboard motors OMs, OMp is driven in reverse. Therefore, the resultant propulsive force 73 can have a greater lateral component with respect to the lateral direction of the hull 2. As the steering angles of the two outboard motors OMs, OMp increase in absolute value, the lateral component of the resultant propulsive force 73 is increased. In FIG. 5A and the like, the resultant propulsive force 73 is illustrated as being parallel to the lateral direction of the hull 2 (i.e., lateral movement) by way of example. Where the propulsive forces 72*s*, 72*p* have different magnitudes, the resultant propulsive force 73 is directed obliquely with respect to the lateral direction of the hull 2 and, therefore, is applied to the hull 2 for oblique translation.

In the cooperative mode, on the other hand, the bow thruster BT is actuated to generate a propulsive force as shown in FIG. 5B. The steering angles of the two outboard motors OM are controlled so that the propulsive force action lines 71*s*, 71*p* of the outboard motors OM cross each other on the rear side of the turning center 70 (resistance center) of the hull 2. The action point of the resultant propulsive force 73 of the propulsive forces 72*s*, 72*p* generated by the two outboard motors OM is the intersection of the propulsive force action lines 71*s*, 71*p*, so that a moment is applied to the hull 2 about the turning center 70. On the other hand, the propulsive force 74 generated by the bow thruster BT also applies a moment to the hull 2 about the turning center 70. Therefore, the propulsive forces 72*s*, 72*p*, 74 of the outboard motors OM and the bow thruster BT are controlled so as to balance the moments applied to the hull 2 by the resultant propulsive force 73 of the two outboard motors OM and the propulsive force 74 of the bow thruster BT. Thus, the hull 2 translates (moves laterally) without the bow turning. In the cooperative mode in which the bow thruster BT and the two outboard motors OM are used in combination, the overall propulsive force contributable to the translation is greater than in the non-cooperative mode, making it possible to smoothly translate the hull 2. More specifically, the hull 2 can start moving earlier.

In this preferred embodiment, the translation mode steering angles are the steering angles of the two outboard motors OM observed when the propulsive force action lines 71*s*, 71*p* of the two outboard motors OM cross each other on a line extending anteroposteriorly through the turning center 70 in the hull 2 (on the center line 2*a* when the turning center 70 is on the center line 2*a*). In the non-cooperative mode, the translation mode steering angles without the bow turning of the hull 2 are the steering angles of the two outboard motors OM observed when the propulsive force action lines 71*s*, 71*p* of the two outboard motors OM cross each other at the turning center 70. In the cooperative mode, the translation mode steering angles without the bow turning of the hull 2 are the steering angles of the two outboard motors OM observed when the propulsive force action lines 71*s*, 71*p* of the two outboard motors OM cross each other on the rear side of the turning center 70.

Figure 5C:
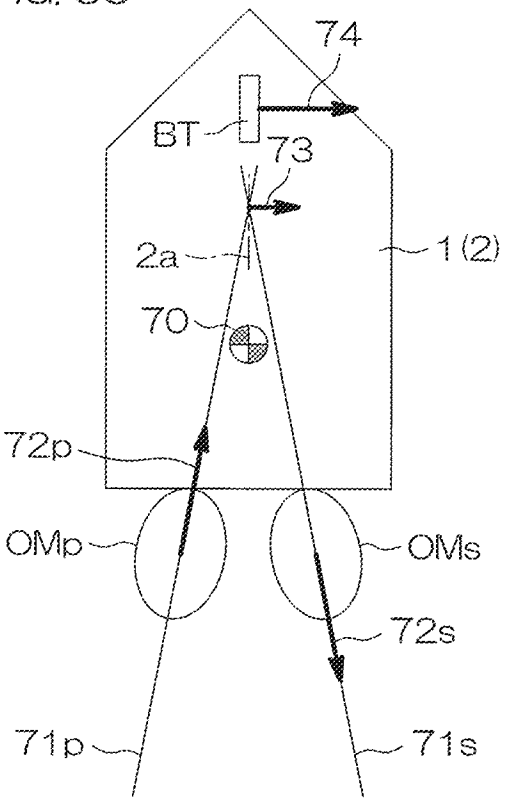
FIGS. 5C to 5E are diagrams for describing examples of the translation with bow turning to be observed in the cooperative mode.
Figure 5D:
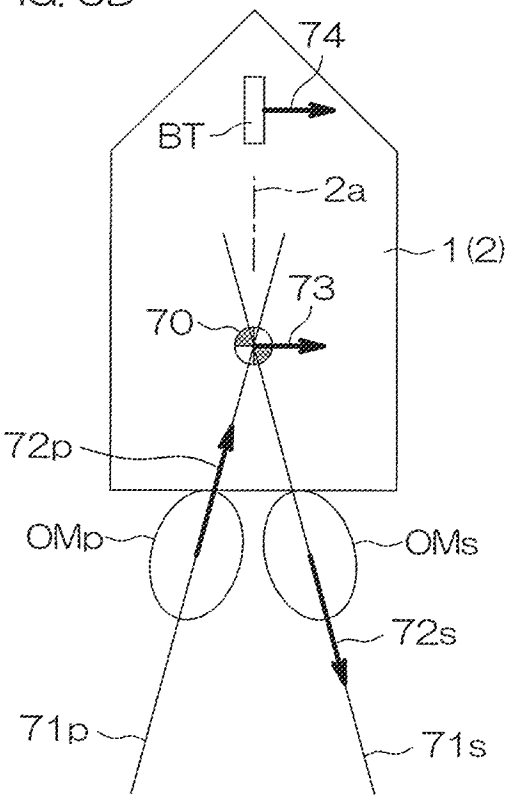
Figure 5E:
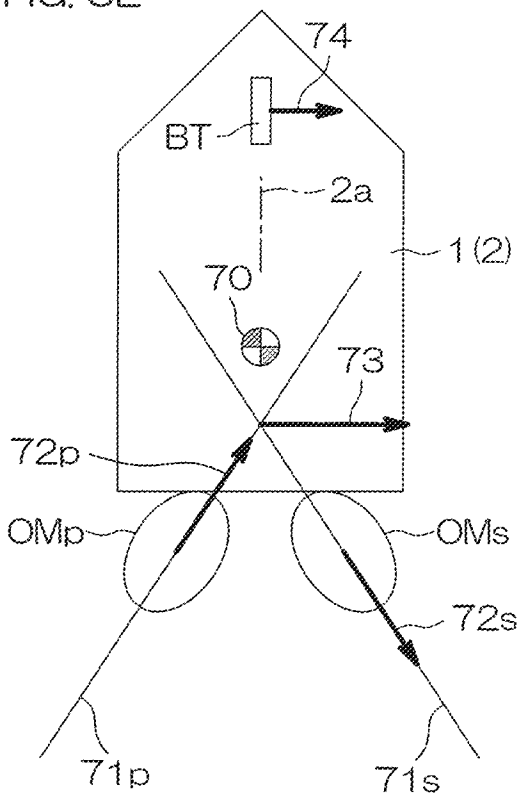

When the joystick 8 is inclined and pivoted, the hull 2 is in a hull behavior such that the bow is turned in a direction corresponding to the pivoting direction of the joystick 8 while the hull 2 is moved in a direction corresponding to the inclination direction of the joystick 8. In the cooperative mode, for example, the hull 2 can be translated with the bow turning depending on the magnitude balance between the propulsive force 74 of the bow thruster BT and the resultant propulsive force 73 of the two outboard motors OM as shown in FIGS. 5C to 5E.

In the non-cooperative mode, though not shown, the hull 2 can be translated with the bow turning by controlling the steering angles of the two outboard motors OM so that the propulsive force action lines 71*s*, 71*p* of the two outboard motors OM cross each other on the front side or the rear side of the turning center 70.

The resultant propulsive force 73 of the two outboard motors OM depends on the directions and the magnitudes of the propulsive forces 72*s*, 72*p* of the outboard motors OM, i.e., the steering angles and the outputs (engine rotation speeds) of the respective outboard motors OM. That is, even with the same engine outputs, the resultant propulsive force 73 is relatively reduced by reducing the absolute values of the steering angles to relatively reduce (or narrow) an angle defined between the two outboard motors OM as shown in FIGS. 5C and 5D. Further, even with the same engine outputs, the resultant propulsive force 73 is relatively increased by increasing the absolute values of the steering angles to relatively increase (or expand) the angle defined between the two outboard motors OM as shown in FIG. 5E.

When the joystick 8 is pivoted (twisted) without being inclined in the joystick mode, the bow of the hull 2 is turned in a direction corresponding to the pivoting direction of the joystick 8 without any substantial position change. That is, the hull 2 is in a hull behavior of fixed point bow turning. Examples of the fixed point bow turning are shown in FIG. 4B.

At this time, the steering angles of the two outboard motors OM are set to zero (bow turning mode steering angles) so that the two outboard motors OM generate propulsive forces parallel to the center line 2*a*. That is, the propulsive force action lines of the two outboard motors OM are parallel to the center line 2*a*, i.e., parallel to the anteroposterior direction of the hull 2. For the fixed point bow turning, one of the outboard motors OM is driven forward, and the other outboard motor OM is driven in reverse such that a moment can be applied to the hull 2 about the turning center. For the fixed point bow turning in a leftward direction (in a counterclockwise direction as seen in plan), the starboard-side outboard motor OMs is driven forward, and the port-side outboard motor OMp is driven in reverse. For the fixed point bow turning in a rightward direction (in a clockwise direction as seen in plan), the starboard-side outboard motor OMs is driven in reverse, and the port-side outboard motor OMp is driven forward.

In the non-cooperative mode, the bow thruster BT is in the stop state. In the cooperative mode, the bow thruster BT also generates a propulsive force to promote the bow turning. That is, the bow thruster BT applies a leftward propulsive force to the hull 2 for the fixed point bow turning in the leftward direction (in the counterclockwise direction as seen in plan). For the fixed point bow turning in the rightward direction (in the clockwise direction as seen in plan), the bow thruster BT applies a rightward propulsive force to the hull 2.

Figure 6A:
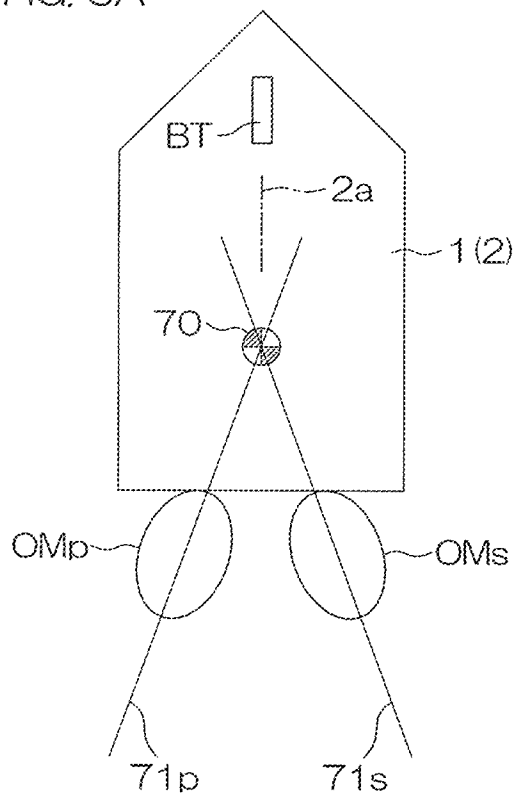
FIGS. 6A to 6C are diagrams for describing a steering angle control to be performed in the joystick mode in the cooperative mode.
Figure 6B:
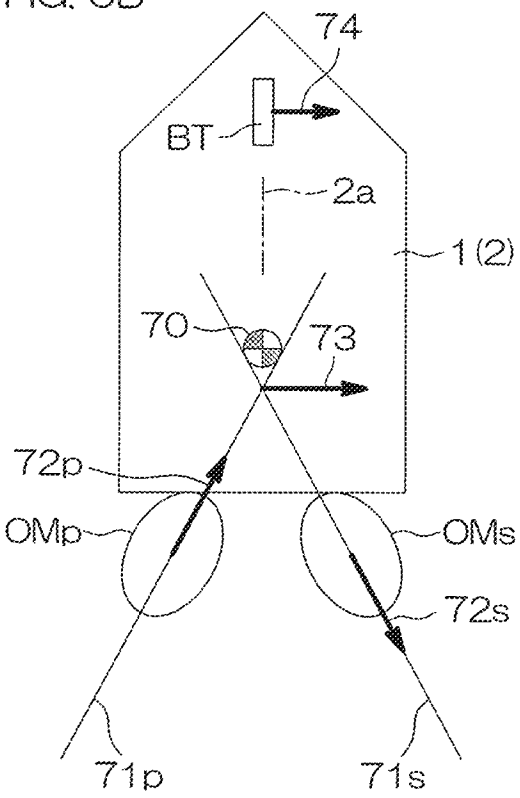
Figure 6C:
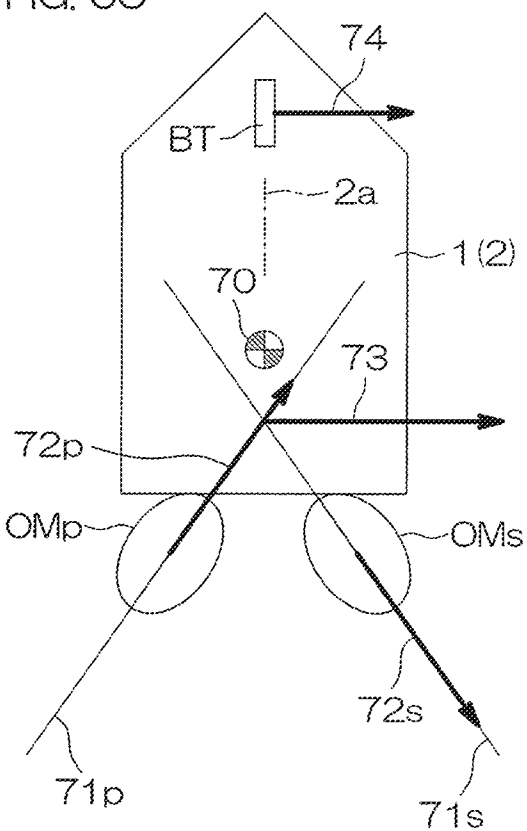

FIGS. 6A to 6C are diagrams for describing a steering angle control to be performed in the joystick mode in the cooperative mode.

Without the operation of the joystick 8 by the user, the joystick 8 is in the neutral position, and the main controller 50 stands by for the operation of the joystick 8 in a standby state. At this time, as shown in FIG. 6A, the main controller 50 does not cause the bow thruster BT and the two outboard motors OM to generate the propulsive forces, and controls the steering angles of the two outboard motors OM to translation standby steering angles. The translation standby steering angles are categorized as the translation mode steering angles, but are smaller in absolute value than reference translation steering angles (see FIG. 6C) which are the translation mode steering angles to be used when the propulsive forces are generated to translate the hull 2 without the bow turning. That is, the translation standby steering angles are such that the angle defined between the propulsive force action lines 71*s*, 71*p* of the two outboard motors OM is relatively small, and the intersection of the propulsive force action lines 71*s*, 71*p* is located relatively forward in the hull 2.

When the joystick 8 is inclined, i.e., when the joystick 8 is operated to command the translation of the hull 2, the main controller 50 causes the bow thruster BT and the outboard motors OM to start generating the propulsive forces 74, 72*s*, 72*p* as shown in FIG. 6B. Further, the main controller 50 gradually changes the steering angles of the two outboard motors OM toward the translation steering angles. More specifically, the steering angles of the two outboard motors OM are gradually increased in absolute value. Then, the propulsive forces 74, 72*s*, 72*p* of the bow thruster BT and the outboard motors OM are increased toward command values. When the steering angles of the two outboard motors OM reach the translation steering angles, a state shown in FIG. 6C is achieved. As the absolute values of the steering angles increase, the lateral component of the resultant propulsive force 73 of the two outboard motors OM is increased. Therefore, with the steering angles of the two outboard motors OM set to the translation standby steering angles immediately after the operation of the joystick 8, the lateral component of the resultant propulsive force 73 of the two outboard motors OM can be relatively reduced. Thereafter, the steering angles of the two outboard motors OM are changed (increased in absolute value) toward the translation steering angles such that the lateral component of the resultant propulsive force 73 is increased. Thus, even immediately after the operation of the joystick 8, the propulsive force 74 of the bow thruster BT and the resultant propulsive force 73 of the two outboard motors OM can be properly balanced, thus achieving an excellent hull behavior.

The steering speeds (the change rates of the steering angles) at which the steering angles are gradually changed are set in accordance with the propulsive force increasing characteristic of the bow thruster BT. Specifically, the electric motor 42 of the bow thruster BT reaches the rotation speed commanded by the main controller 50 with a delay after the driving of the electric motor 42 is started. Further, the propulsive force is generated by generation of a water jet with a delay after the rotation of the propeller 40 is started. In consideration of these delays, the steering speeds are preferably set so as to correct the behavior of the bow at the beginning of the operation of the joystick 8. For example, the main controller 50 applies the steering angle command to the outboard motors OM via the remote control ECUs 51 at every control cycle. The steering angles indicated by the steering angle command are each changed by a constant change amount at every control cycle such that the steering speeds can be controlled. The steering speeds can be properly controlled by properly setting the change amount. At the beginning of the operation of the joystick 8, the delay or the advance of the bow can be minimized by properly setting the steering speeds. Thus, an excellent hull behavior can be achieved.

When the joystick 8 is no longer operated, the joystick 8 is returned to the neutral position. Then, the main controller 50 stops the driving of the bow thruster BT, and brings the two outboard motors OM into the stop state (with the shift positions of the two outboard motors OM in the neutral shift positions). Further, the main controller 50 controls the steering angles of the two outboard motors OM to the translation standby steering angles (see FIG. 6A).

As described above, the joystick 8 can be inclined and, at the same time, twisted to input a bow turning command as well as a translation command to the main controller 50. In this case, for example, the main controller 50 changes the absolute values of the steering angles of the two outboard motors OM, as shown in FIGS. 5C to 5E, with respect to the reference translation steering angles (shown in FIG. 6C). Thus, the bow turning moment to be applied to the hull 2 by the resultant propulsive force 73 of the two outboard motors OM and the bow turning moment to be applied to the hull 2 by the propulsive force 74 of the bow thruster BT are adjusted in a proper magnitude relationship and a proper direction relationship such that the bow of the hull 2 can be correspondingly turned.

More specifically, if a bow turning command is inputted to direct the bow in the translation movement direction, the main controller 50 reduces the absolute values of the steering angles to smaller than the reference translation steering angles (see FIG. 6C) to reduce the resultant propulsive force 73 of the two outboard motors OM (see FIGS. 5C and 5D). At this time, the absolute values of the steering angles are controlled to be minimized when the bow turning command is maximum. The absolute values of the steering angles to be set for the translation movement may be designed so as to be minimized, as shown in FIG. 5C, when the propulsive force action lines 71*s*, 71*p* cross each other on the front side of the turning center 70. When the propulsive force action lines 71*s*, 71*p* cross each other on the front side of the turning center 70, as shown in FIG. 5C, the resultant propulsive force 73 applies the bow turning moment to the hull 2 in the same direction as that of the propulsive force 74 of the bow thruster BT.

On the other hand, if a bow turning command is inputted to direct the bow in a direction opposite to the translation movement direction, the main controller 50 increases the absolute values of the steering angles to greater than the reference translation steering angles (see FIG. 6C) to increase the resultant propulsive force of the two outboard motors OM (see FIG. 5E). At this time, the absolute values of the steering angles are controlled to be maximized when the bow turning command is maximum. The absolute values of the steering angles set for the translation movement may correspond to the mechanical limit steering angles of the outboard motors OM or the like.

Where the user stops twisting the joystick 8 and still inclines the joystick 8, the bow turning command is absent and only the translation command is present. In this case, the main controller 50 controls the steering angles of the two outboard motors OM to the translation steering angles. At this time, the steering angles of the two outboard motors OM do not need to be once set to the translation standby steering angles (see FIG. 6A).

Figure 7A:
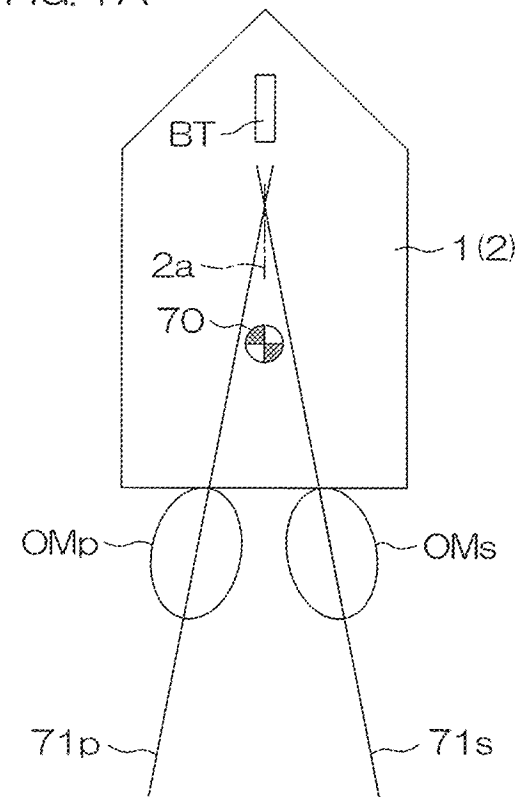
FIGS. 7A to 7C are diagrams for describing a steering angle control to be performed in the non-cooperative mode.
Figure 7B:
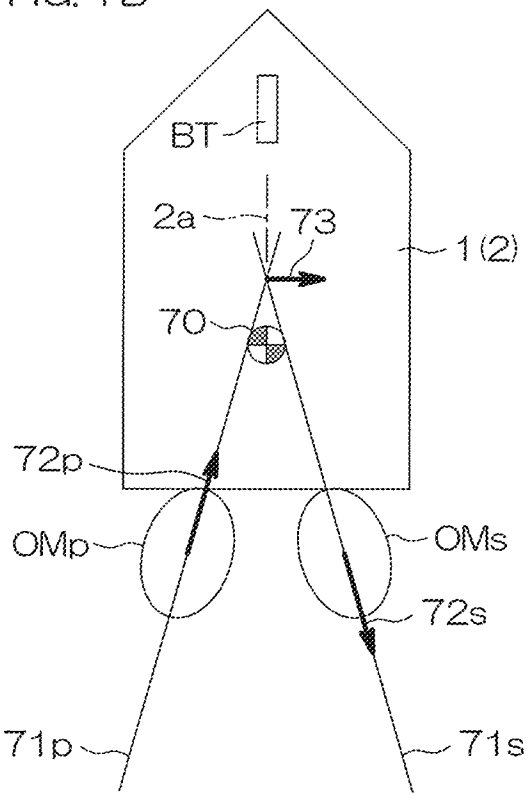
Figure 7C:
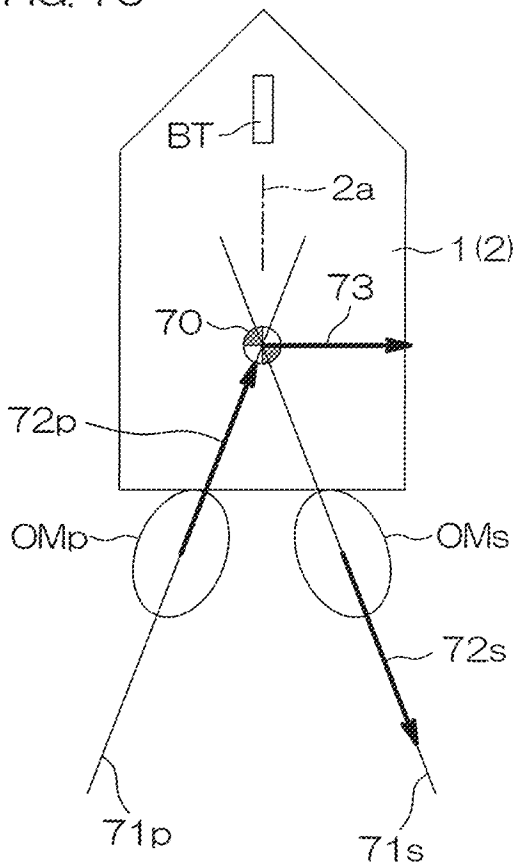

FIGS. 7A to 7C are diagrams for describing a steering angle control to be performed in the non-cooperative mode. In the non-cooperative mode, the translation movement can be achieved with the use of the propulsive forces of the two outboard motors OM without driving the bow thruster BT.

Without the operation of the joystick 8 by the user, the joystick 8 is in the neutral position, and the main controller 50 stands by for the operation of the joystick 8 in the standby state. At this time, as shown in FIG. 7A, the main controller 50 does not cause the two outboard motors OM to generate the propulsive forces, and controls the steering angles of the two outboard motors OM to translation standby steering angles for the non-cooperative mode (hereinafter referred to as "non-cooperative translation standby steering angles"). The non-cooperative translation standby steering angles are categorized as the translation mode steering angles, but are smaller in absolute value than reference non-cooperative translation steering angles (see FIG. 7C) which are the translation mode steering angles to be used when the propulsive forces are generated to translate the hull 2 without the bow turning in the non-cooperative mode. That is, the non-cooperative translation standby steering angles are such that the angle defined between the propulsive force action lines 71*s*, 71*p* of the two outboard motors OM is relatively small, and the intersection of the propulsive force action lines 71*s*, 71*p* is located relatively forward in the hull 2. More specifically, with the steering angles set to the reference non-cooperative translation steering angles (see FIG. 7C), the propulsive force action lines 71*s*, 71*p* cross each other at the turning center 70. Therefore, with the steering angles set to the non-cooperative translation standby steering angles, the intersection of the propulsive force action lines 71*s*, 71*p* is located on the front side of the turning center 70.

When the joystick 8 is inclined, i.e., when the joystick 8 is operated to command the translation of the hull 2, the main controller 50 causes the outboard motors OM to start generating the propulsive forces 72*s*, 72*p* as shown in FIG. 7B. Further, the main controller 50 gradually changes the steering angles of the two outboard motors OM toward the non-cooperative translation steering angles. That is, the steering angles of the two outboard motors OM are gradually increased in absolute value. Then, the propulsive forces 72*s*, 72*p* of the outboard motors OM are increased to command values. When the steering angles of the two outboard motors OM reach the non-cooperative translation steering angles, a state shown in FIG. 7C is achieved. At this time, the intersection of the propulsive force action lines 71*s*, 71*p* of the two outboard motors OM is present at the turning center 70, and the resultant propulsive force 73 of the two outboard motors OM acts on the hull 2 at the intersection. Therefore, the resultant propulsive force 73 applies no bow turning moment to the hull 2. Thus, the hull 2 is translated without the bow turning.

The steering speeds (the change rates of the steering angles) at which the steering angles are gradually changed are set so as to correct for the delay of the bow. When the outboard motors OM start generating the propulsive forces 72*s*, 72*p* with the steering angles thereof set to the non-cooperative translation steering angles (see FIG. 7C), the bow is moved in the translation movement direction with a delay and, therefore, is slightly turned. To cope with this, the outboard motors OM start generating the propulsive forces 72*s*, 72*p* with the steering angles thereof set to the non-cooperative translation standby steering angles smaller than the non-cooperative translation steering angles. Then, as shown in FIG. 7B, with the intersection of the propulsive force action lines 71*s*, 71*p* present on the front side of the turning center 70, the resultant propulsive force 73 acts on the hull 2 such that the bow turning moment is applied to the hull 2 to direct the bow in the translation movement direction. Through this situation, the steering angles reach the non-cooperative translation steering angles shown in FIG. 7C, making it possible to translate the hull 2 while reducing the delay of the bow. The steering speeds may be controlled in the same manner as described above for the cooperative mode. The proper setting of the steering speeds makes it possible to correct for the delay of the bow at the beginning of the operation of the joystick 8. Thus, an excellent hull behavior can be achieved.

When the joystick 8 is no longer operated, the joystick 8 is returned to the neutral position. Then, the main controller 50 stops the two outboard motors OM (with the shift positions of the two outboard motors OM in the neutral shift positions). Further, the main controller 50 controls the steering angles of the two outboard motors OM to the non-cooperative translation standby steering angles (see FIG. 7A).

With the joystick 8 inclined and, at the same time, twisted, the bow turning command as well as the translation command can be inputted to the main controller 50. In this case, the main controller 50 changes the absolute values of the steering angles of the two outboard motors OM with respect to the reference non-cooperative translation steering angles in the state shown in FIG. 7C. Thus, the intersection of the propulsive force action lines 71*s*, 71*p* is moved anteroposteriorly on the line extending through the turning center 70 anteroposteriorly of the hull 2 (on the center line 2*a* if the turning center 70 is present on the center line 2*a*). Thus, the bow turning moment can be applied to the hull 2 by the resultant propulsive force 73.

More specifically, if the bow turning command is inputted to direct the bow in the translation movement direction, the main controller 50 reduces the absolute values of the steering angles to smaller than the reference non-cooperative translation steering angles (see FIG. 7C) to move the action point of the resultant propulsive force 73 (the intersection of the propulsive force action lines 71*s*, 71*p*) to the front side of the turning center 70. Further, if the bow turning command is inputted to direct the bow in the direction opposite to the translation movement direction, the main controller 50 increases the absolute values of the steering angles to greater than the reference non-cooperative translation steering angles (see FIG. 7C) to move the action point of the resultant propulsive force 73 to the rear side of the turning center 70. Thus, the resultant propulsive force 73 is applied to the hull 2 for the translation movement and to provide the bow turning moment.

Where the user stops twisting the joystick 8 and still inclines the joystick 8, the bow turning command is absent and only the translation command is present. In this case, the main controller 50 controls the steering angles of the two outboard motors OM to the non-cooperative translation steering angles. At this time, the steering angles of the two outboard motors OM do not need to be once set to the non-cooperative translation standby steering angles (see FIG. 7A).

The non-cooperative translation standby steering angles (see FIG. 7A) are preferably smaller in absolute value than the translation standby steering angles for the cooperative mode (see FIG. 6A). That is, the translation standby steering angles for the cooperative mode are preferably greater in absolute value than the non-cooperative translation standby steering angles. This reduces differences between the translation standby steering angles and the translation steering angles in the cooperative mode.

For the translation movement without the bow turning, the non-cooperative translation steering angles (see FIG. 7C) are smaller in absolute value than the translation steering angles for the cooperative mode (see FIG. 6C). In the cooperative mode, the absolute values of the translation steering angles are increased, thus making it possible to effectively utilize the propulsive forces of the outboard motors OM for the lateral translation while utilizing the propulsive force of the bow thruster BT to reduce the bow turning of the hull 2 for the translation of the hull 2. In comprehensive consideration of the translation with and without the bow turning, the translation steering angles for the cooperative mode are often such that the propulsive force action lines 71*s*, 71*p* of the two outboard motors OM cross each other at the turning center 70 (see FIG. 5D) or on the rear side of the turning center 70 (see FIGS. 5E, 6B and 6C). With the propulsive force action lines 71*s*, 71*p* of the two outboard motors OM crossing each other on the rear side of the turning center 70, the bow turning moment applied to the hull 2 by the resultant propulsive force 73 can be cancelled (at least partially cancelled) by the bow turning moment applied to the hull 2 by the propulsive force 74 of the bow thruster BT. Thus, the hull 2 can be translated with the bow turning of the hull 2 properly controlled. Where the translation movement accompanies the bow turning or a greater external disturbance is present, the translation steering angles may be set so as to allow the propulsive force action lines 71*s*, 71*p* of the two outboard motors OM to cross each other at the turning center 70 or on the front side of the turning center 70 in order to maximally utilize the bow turning moment applied by the propulsive force 74 of the bow thruster BT (see FIGS. 5C and 5D).

It is considered that, immediately after the operation of the joystick 8, the translation steering angles are often set so as to allow the propulsive force action lines 71*s*, 71*p* of the two outboard motors OM to cross each other on the rear side of the turning center 70. Therefore, the translation standby steering angles for the cooperative mode are preferably such that the propulsive force action lines 71*s*, 71*p* of the two outboard motors OM cross each other at the turning center 70 (see FIG. 6A) or on the rear side of the turning center 70. In an initial period of time immediately after the operation of the joystick 8 is started, the action point of the resultant propulsive force 73 is located at the turning center 70 or on the rear side of the turning center 70. In a period of time during which the steering angles are changed from the translation standby steering angles to the translation steering angles, therefore, the direction of the bow turning moment applied to the hull 2 by the resultant propulsive force 73 is not changed in most cases. Thus, an excellent hull behavior can be achieved.

While preferred embodiments of the present invention have thus been described, the present invention may be embodied in some other ways.

In a preferred embodiment described above, the two outboard motors OM are provided on the stern 3 by way of example. The number of the outboard motors OM may be three or more. In a preferred embodiment described above, the engine outboard motors are used as the propulsion devices by way of example, but instead electric outboard motors may be employed. Further, the propulsion devices are not necessarily required to be the outboard motors, but may be inboard motors, inboard/outboard motors (stern drives), waterjet propulsion devices and other types of propulsion devices.

In a preferred embodiment described above, the bow thruster BT is able to generate the propulsive force only laterally leftward and rightward by way of example. Alternatively, a steerable propulsion device such as an electric trolling motor may be provided at the bow instead of the propulsion device able to generate the propulsive force only laterally leftward and rightward. That is, the bow thruster may be a propulsion device provided at the bow and able to generate the propulsive force laterally leftward and rightward and further generate the propulsive force in directions other than the leftward and rightward directions.

In a preferred embodiment described above, the watercraft propulsion system 100 includes the cooperative mode in which the outboard motors OM and the bow thruster BT are controlled in a cooperative manner, and the non-cooperative mode in which the cooperative control is not performed by way of example. However, the non-cooperative mode may be omitted.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A watercraft propulsion system comprising:

a bow thruster at a bow of a hull to generate a lateral propulsive force;

at least two propulsion devices on a stern of the hull each having a variable steering angle;

a steering wheel to be operated by a user;

a remote control lever to be operated by the user;

a translation operator to be operated by the user to command a hull translation movement; and a controller configured or programmed to control the at least two propulsion devices responsive to the operation on the steering wheel and the remote control lever in an ordinary mode, and to control the bow thruster and the at least two propulsion devices responsive to the operation on the translation operator in a translation watercraft maneuvering mode; wherein the controller is configured or programmed to, in the translation watercraft maneuvering mode, control the steering angles of the at least two propulsion devices so that propulsive force action lines of the at least two propulsion devices cross each other in the hull, and drive one of the at least two propulsion devices forward and drive another of the at least two propulsion devices in reverse in response to the operation of the translation operator;

the controller is configured or programmed to, in a standby state in the translation watercraft maneuvering mode without the operation of the translation operator, prevent the bow thruster and the at least two propulsion devices from generating propulsive forces, and set the steering angles of the at least two propulsion devices to translation standby steering angles that are predetermined so that the propulsive force action lines of the at least two propulsion devices cross each other in the hull;

the controller is configured or programmed to cause the bow thruster and the at least two propulsion devices to start generating the propulsive forces, and change the steering angles of the at least two propulsion devices from the translation standby steering angles to translation steering angles in response to the operation of the translation operator so that the propulsive force action lines of the at least two propulsion devices cross each other in the hull; and steering speeds at which the steering angles of the at least two propulsion devices are respectively changed from the translation standby steering angles to the translation steering angles are set in accordance with a propulsive force increasing characteristic of the bow thruster.

2. The watercraft propulsion system according to claim 1, wherein the translation standby steering angles are smaller in absolute value than the translation steering angles when the hull is translated without bow turning of the hull.

3. The watercraft propulsion system according to claim 1, wherein the controller includes a cooperative mode in which the bow thruster and the at least two propulsion devices are cooperatively driven and a non-cooperative mode in which the bow thruster is stopped; and the controller is configured or programmed to cause the at least two propulsion devices to generate the propulsive forces, and control the steering angles of the at least two propulsion devices to non-cooperative translation steering angles different from the translation steering angles in response to the operation of the translation operator when the translation watercraft maneuvering mode is effected in the non-cooperative mode.

4. The watercraft propulsion system according to claim 3, wherein the controller is configured or programmed to prevent the at least two propulsion devices from generating the propulsive forces, and control the steering angles of the at least two propulsion devices to non-cooperative translation standby steering angles smaller in absolute value than the translation standby steering angles in the standby state without the operation of the translation operator when the translation watercraft maneuvering mode is effected in the non-cooperative mode.

5. The watercraft propulsion system according to claim 3, wherein when the hull is translated without bow turning of the hull in the non-cooperative mode, the non-cooperative translation steering angles are such that the propulsive force action lines of the at least two propulsion devices cross each other at a turning center of the hull.

6. The watercraft propulsion system according to claim 1, wherein the translation standby steering angles are such that the propulsive force action lines of the at least two propulsion devices cross each other at a turning center of the hull or on a rear side of the turning center of the hull.

7. The watercraft propulsion system according to claim 1, wherein the at least two propulsion devices are outboard motors.

8. A watercraft comprising:

a hull; and the watercraft propulsion system according to claim 1 on the hull.

9. A watercraft propulsion system comprising:

a bow thruster at a bow of a hull to generate a lateral propulsive force;

at least two propulsion devices on a stern of the hull each having a variable steering angle;

a steering wheel to be operable by a user;

a remote control lever to be operable by the user;

a translation operator to be operated by the user to command a hull translation movement; and a controller configured or programmed to control the at least two propulsion devices responsive to the operation on the steering wheel and the remote control lever in an ordinary mode, and to control the bow thruster and the at least two propulsion devices responsive to the operation on the translation operator in a translation watercraft maneuvering mode; wherein the controller is configured or programmed to, in the translation watercraft maneuvering mode, control the steering angles of the at least two propulsion devices so that propulsive force action lines of the at least two propulsion devices cross each other in the hull, and drive one of the at least two propulsion devices forward and drive another of the at least two propulsion devices in reverse in response to the operation of the translation operator;

the controller is configured or programmed to, in a standby state in the translation watercraft maneuvering mode without the operation of the translation operator, prevent the bow thruster and the at least two propulsion devices from generating propulsive forces, and set the steering angles of the at least two propulsion devices to translation standby steering angles that are predetermined so that the propulsive force action lines of the at least two propulsion devices cross each other in the hull;

the controller is configured or programmed to cause the bow thruster and the at least two propulsion devices to start generating the propulsive forces, and change the steering angles of the at least two propulsion devices from the translation standby steering angles to translation steering angles in response to the operation of the translation operator so that the propulsive force action lines of the at least two propulsion devices cross each other in the hull; and the translation standby steering angles are smaller in absolute value than the translation steering angles when the hull is translated without bow turning of the hull.

10. The watercraft propulsion system according to claim 9, wherein the at least two propulsion devices are outboard motors.

11. A watercraft comprising:

a hull; and the watercraft propulsion system according to claim 9 on the hull.

* * * * *